US005146895A

United States Patent [19]

Fehlmann et al.

[11] Patent Number: 5,146,895

[45] Date of Patent: Sep. 15, 1992

[54] FUEL INJECTION PUMP FOR INTERNAL COMBUSTION ENGINES

[75] Inventors: Wolfgang Fehlmann, Stuttgart; Helmut Laufer, Gerlingen; Ewald Eblen, Stuttgart, all of Fed. Rep. of Germany

[73] Assignee: Robert Bosch GmbH, Stuttgart, Fed. Rep. of Germany

[21] Appl. No.: 691,022

[22] PCT Filed: Nov. 24, 1990

[86] PCT No.: PCT/DE90/00904

§ 371 Date: Jun. 28, 1991

§ 102(e) Date: Jun. 28, 1991

[87] PCT Pub. No.: WO91/10063

PCT Pub. Date: Jul. 11, 1991

[30] Foreign Application Priority Data

Dec. 29, 1989 [DE] Fed. Rep. of Germany ..... 3943299

[51] Int. Cl.[5] ..... F01M 39/00

[52] U.S. Cl. ..... 123/449; 123/495; 417/372

[58] Field of Search ..... 123/449, 495, 502, 506, 123/509; 417/372

[56] References Cited

U.S. PATENT DOCUMENTS 2,670,684 3/1954 Fagerholt ..... 417/372
4,493,623 1/1985 Nelson ..... 417/372
4,697,565 10/1987 Kabayashi et al. ..... 123/449
4,818,192 4/1989 Korthaus ..... 417/372
4,873,956 10/1989 Fehlmann et al. ..... 123/449
5,000,668 -3/1991 Nakamura et al. ..... 123/449
5,007,400 4/1991 Babitzka ..... 123/449

*Primary Examiner*—Carl S. Miller
*Assistant Examiner*—Thomas N. Moulis
*Attorney, Agent, or Firm*—Edwin E. Greigg; Ronald E. Greigg

[57] ABSTRACT

A fuel injection pump for internal combustion engines comprising a pump housing, a distributor piston guided axially and rotatably, a rotating drive shaft supported in the pump housing, a transmission coupling the drive shaft to the distributor piston and a claw clutch and an eccentric disk rolling on a roller race with cams, and a lubricating oil circulation loop, which has a lubricating oil feed line discharging into a lubricating oil groove and a lubricating oil return line that returns from the transmission chamber which is partly filled with lubricating oil. To assure adequate supply of lubricating oil to the heavily loaded drive faces of the claw clutch, there is a flow lubricating oil through the drive shaft from the lubricating oil groove on into the claw clutch; via lubricating oil openings in at least those claw faces of the claw clutch that transmit a torque, the flow emerges into the transmission chamber.

20 Claims, 3 Drawing Sheets

FUEL INJECTION PUMP FOR INTERNAL COMBUSTION ENGINES

BACKGROUND OF THE INVENTION

The invention is based on a fuel injection pump for internal combustion engines.

In a known fuel injection pump of this type (German Patent 1 263 397), the transmission chamber is completely filled with lubricating fluid, and the motor oil from the engine oil circulation loop is typically used as the lubricating fluid. Because of the relatively high viscosity of motor oil, the limit rpm of the cam transmission, that is, the rpm of the drive shaft at which the eccentric disk "derails" and no longer rolls off the rollers of the roller race, is quite low. This limits the use of this fuel injection pump to low-speed Diesel engines.

In another known fuel injection pump (German Published, Unexamined Patent Application 36 05 452), the transmission chamber is only partly filled with lubricating medium, because a drainage bore is disposed in it in a spatially suitable manner; as a result, the rpm limit of the cam transmission can be increased substantially. However, it has been found that at high drive rpm, the lubricating fluid collects in the outer region of the driving mechanism part, and the driving claws of the claw clutch, which are located near the center and must transmit considerable torque, are not lubricated. The result is rapid wear and a disproportionately short service life of the fuel injection pump.

ADVANTAGES OF THE INVENTION

The fuel injection pump according to the invention has an advantage over the prior art that because the transmission chamber is only partly filled, again with lubricating medium, the rpm limit of the cam transmission is quite high, and even in the region of the high drive rpm of the drive shaft, which is near the rpm limit, the heavily loaded drive faces of the claw clutch are adequately lubricated. This increases the service life of the fuel injection pump drastically.

Advantageous further developments of and improvements to the fuel injection pump disclosed herein are possible with the provisions recited herein; the term "lubricating oil" will be used as a synonym for all types of lubricating media, and motor oil is used preferably.

In a preferred embodiment of the invention, the flow of lubricating oil compelled by the lubricating oil pump from the lubricating oil groove to the lubrication openings in the claw faces of the claw clutch is attained in a particularly advantageous manner by providing that the drive shaft has an axial blind bore, which communicates with the lubricating oil groove via a radial bore and is closed on the discharge end. From the blind bore, inclined bores lead into the driving claws of the drive shaft, which are closed at the face end. Leading from each inclined bore is one distributor bore into whichever claw faces of the driving claws are transmitting torque in the intended direction of rotation of the drive shaft. The discharge openings of the distributor bores in the claw faces form the lubricating oil openings. The coupling of the driving claws of the drive shaft to the driven claws of the eccentric disk, which is connected to the distributor piston in a manner fixed against relative rotation, is effected via a clutch disk embodied as a cross-shaped disk. In order that the claw faces of the clutch disk that transmit a driving torque will also be adequately lubricated, second distributor bores extend in the clutch disk from the claw faces of the clutch claws that rest on the driving claw faces that have the lubricating oil openings as far as the claw faces of the same clutch claws, which are in the lead in the direction of rotation.

In a further embodiment of the invention, first distributor bores lead from all the claw faces of the driving claws to the inclined bores, and with their discharge openings form the desired lubricating oil openings in the claw faces. In the same way, all the clutch claws are penetrated by second distributor bores, which each discharge in the two claw faces defining the clutch claws, so that each forms one lubricating oil opening there. In this embodiment, all the claw faces are supplied with lubricating oil, regardless of whether they are loaded in the instantaneous direction of drive shaft rotation or not. This has the advantage that the fuel injection pump can be used for both directions of rotation of the drive shaft so that it is unnecessary to keep parts in inventory for both clockwise and counterclockwise rotation of the drive shaft. The oil emerging from the claw faces is spun outward by centrifugal force and lubricates the rollers of the transmission. The lubricating oil circulation loop is maintained by a feed pump, which is driven either by the drive shaft or by a separate electric motor and is generally already present in the engine oil circulation loop.

In fuel injection pumps having a hydraulic injection timing adjuster, the lubricating oil circulation loop required for lubricating the drive shaft and the claw clutch can additionally be used to control the injection timing adjuster. The control chamber defined by the injection adjusting piston is connected to the lubricating oil loop via a throttle and communicates in turn with the transmission chamber, via an electromagnetically actuatable shutoff valve. To generate a control pressure in the control chamber that increases as a function of rpm, in order to displace the control piston and thus the roller race to shift the supply onset to "early" with respect to the rotational position of the drive shaft, the electromagnetic shutoff valve is triggered in a clocked manner.

Since no motor oil pressure exists upon engine starting, the roller race of the cam transmission is installed in a position such that when the injection timing adjuster control chamber is pressureless, the supply onset is at "early" with respect to the rotational position of the drive shaft.

DRAWING

The invention is described in further detail in the ensuing description in terms of exemplary embodiment shown in the drawing. Shown are:

FIG. 1, a schematic view of a fuel injection pump for an internal combustion engine;

FIG. 2, an exploded perspective view of a claw clutch of the fuel injection pump in FIG. 1;

FIG. 3, a side view, partly in section, of a drive shaft of the fuel injection pump of FIG. 1;

FIG. 4, a section taken along the line IV—IV of FIG. 3;

FIG. 5, a section through a clutch disk of the claw clutch in FIG. 2; and FIG. 6, the same view as in FIG. 5 of a clutch disk in a further exemplary embodiment.

DESCRIPTION OF THE PREFERRED EMBODIMENTS

Figure 1:
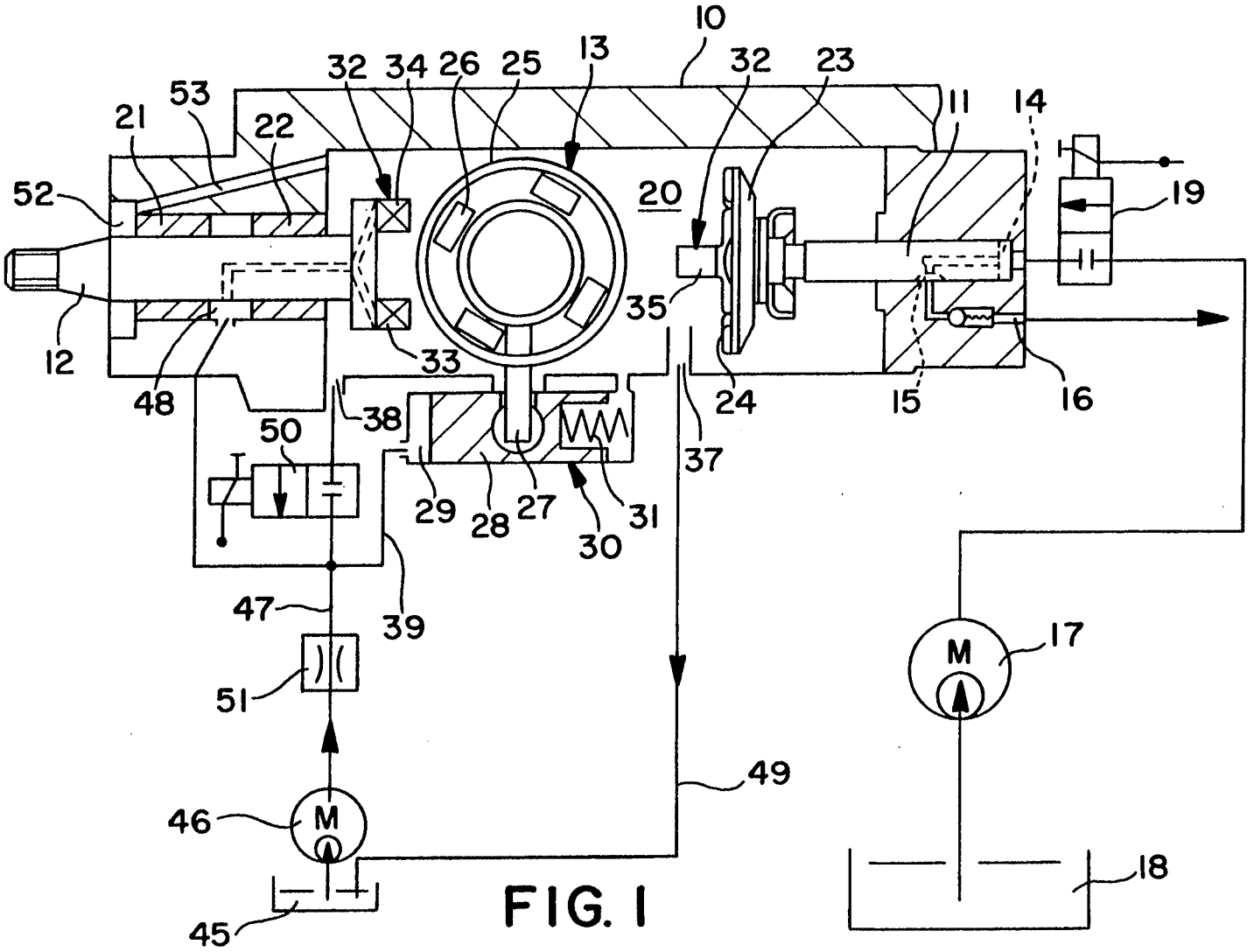

In the fuel injection pump of the distributor type, shown schematically in section in FIG. 1, a pump piston 11 also acting as a distributor is set into simultaneous reciprocating and rotating motion by a drive shaft 12 and with the aid of a cam transmission or cam gear 13. Upon each compression stroke of the pump piston 11, fuel is pumped from a pump work chamber 1 defined by the pump piston 11 via a longitudinal distributor groove 15 to one of a plurality of pressure conduits 16, which are disposed at equal rotational intervals around the pump piston 11 and each of which leads to one injection valve assigned to a combustion chamber of the engine. The pump work chamber 14 is supplied with fuel via a magnet valve 19 by a fuel feed pump 17, which aspirates fuel from a fuel tank 18. During the intake stroke of the pump piston 11, the magnet valve 19 is opened, and it is switched over into its blocking position at the onset of the supply or compression stroke.

The drive shaft 12 is supported in the pump housing 10 by means of two spaced-apart slide bearings 21, 22, and like the end of the pump piston 11 remote from the pump work chamber 14, it protrudes into a transmission chamber 20 receiving the cam gear 13. In a known manner, the cam gear 13 has a cam or eccentric disk 23, which is connected to the pump piston 11 in a manner fixed against relative rotation and which has on its underside remote from the pump piston 11 a number of protrusions or cams 24 corresponding to the number of pressure conduits 16 and disposed offset from one another by equal rotational angles. A roller race 25 disposed coaxially with the eccentric disk 23 is retained in the pump housing 10 in such a manner that it is rotatable about a certain angle. Rollers 26 are rotatably supported in the roller ring 25, and the cam-equipped underside of the eccentric disk 23 is supported by spring force on the rollers. The roller race 25 is coupled in a torsionally engaged manner to an injection adjusting piston 28 of an injection timing adjuster 30 via an adjusting pin 27. The injection adjusting piston 28 defines a control chamber 29 and is displaced counter to the force of a restoring spring 31 by imposition of pressure of the control chamber 29, in the course of which the roller race 25 is rotated via the adjusting pin 27. With the rotation of the roller race 25, the stroke onset of the pump piston 11 and thus the onset of fuel supply is adjusted to "earlier" with respect to the rotational position of the drive shaft 12. In FIG. 1, the roller race 20 with the rollers 26 and the injection timing adjuster 30 are shown rotated by 90° into the plane of the drawing.

Figure 2:
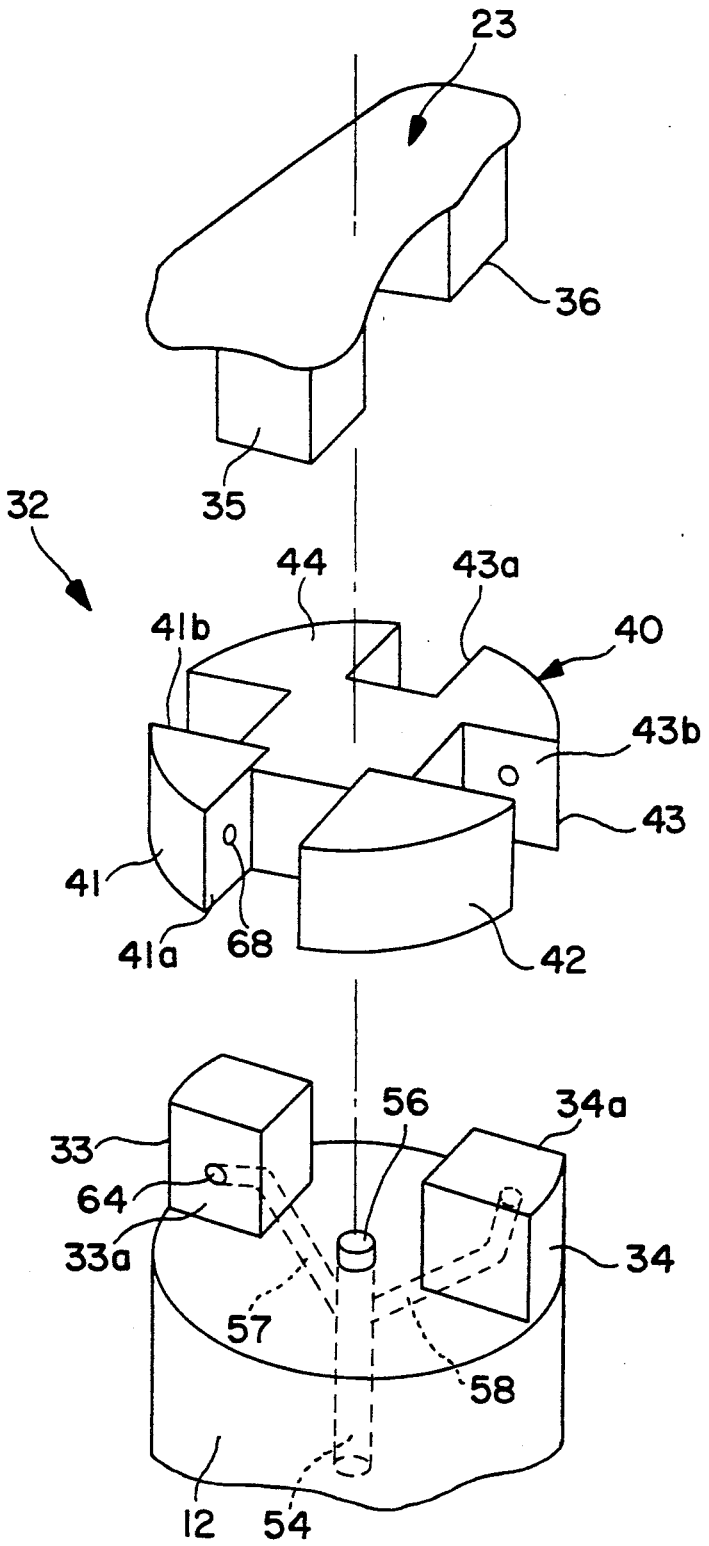
Figure 3:
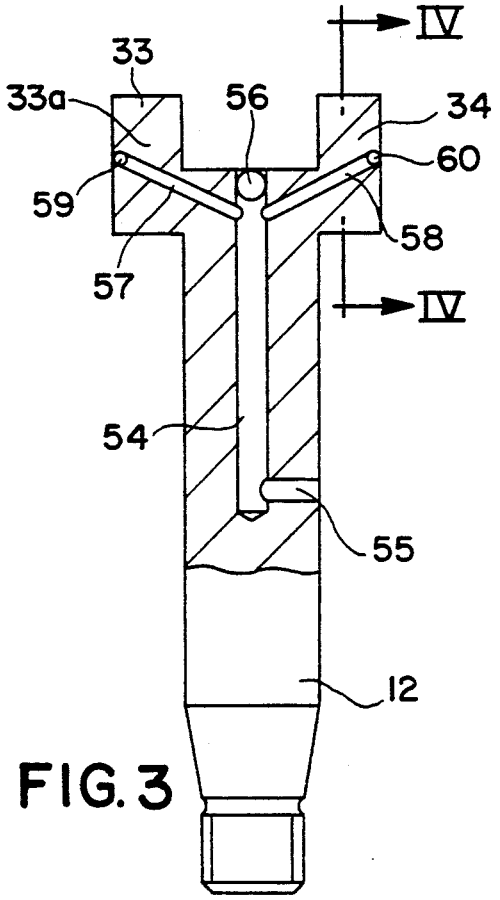
Figure 5:
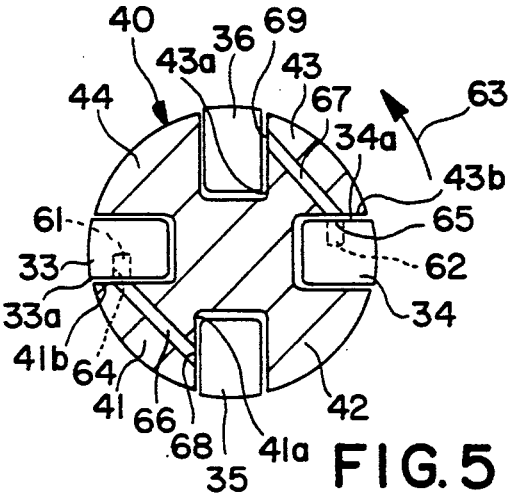
Figure 4:
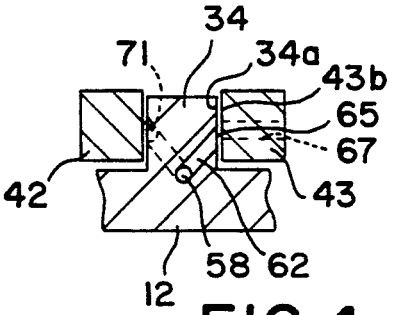

The cam gear 13 also includes a claw clutch 32, which transmits the rotational motion of the drive shaft 12 to the pump piston 11 regardless of the axial reciprocating position of the pump piston 11. As shown in a perspective view in FIG. 2, the claw clutch 32 comprises two driving claws 33, 34, connected to the drive shaft 12 in a manner fixed against relative rotation; two driven claws 35, 36 connected to the eccentric disk 23 in a manner fixed against relative rotation, and which are offset by 90° relative to the driving claws 33, 34 in the direction of rotation of the drive shaft 12; and a cross-type disk 40 with four segment-like clutch claws 41–44, which fit in between the driving claws 33, 34 and the driven claws 35, 36 and establish a connection fixed against relative rotation between these elements. The cross-type disk 40 with the driving claws 33, 34 and the driven claws 35, 36 engaging it is located in the interior of the roller race 20.

A lubricating oil loop has a lubricating oil container 45, from which a lubricating oil pump 46 pumps lubricating oil into a lubricating oil feed line 47. The lubricating oil feed line 47 discharges in a lubricating oil groove 48, embodied as an annular groove between the two slide bearings 21, 22 on the drive shaft 12 in the pump housing 10. A lubricating oil return line 49 connects a drain opening 37 in the transmission chamber 20 with the lubricating oil container 45. An inlet opening 38 in the transmission chamber 20 is connected via a 2/2-way magnet valve 50 to the lubricating oil feed line 47, with which the control chamber 29 of the hydraulic injection timing adjuster 30 also communicates, via a line segment 39. Between the connecting point of the line segment 39 and the lubricating oil pump 46, there is a throttle valve 51. On the end of the outer slide bearing 21 remote from the lubricating oil groove 48, a lubricating oil collecting groove 52 is provided, which is sealed off at its face end and communicates with the transmission chamber 20 via a return bore 53. The lubricating oil supplied to the lubricating oil groove 48 by the lubricating oil pump 46 passes through both slide bearings 21, 22 and reaches the transmission chamber 20 either directly or via the lubricating oil collecting groove 52 and the return bore 53. The drain opening 37 of the transmission chamber is disposed such that the transmission chamber 20 is only partly filled with lubricating oil. Because of this merely partial filling of the transmission chamber 20, the cam gear 13 has a high limit rpm, despite the high viscosity of the motor oil of the engine used as lubricating oil. The limit rpm is defined as the rpm of the drive shaft 12 at which the eccentric disk 23 lifts away from the rollers 26 of the roller race 25, whereupon the precise reciprocating function of the pump piston 11 is no longer assured.

A flow of lubricating oil from the lubricating oil groove 48 through the drive shaft 12 directly to the claw clutch 32 is provided to assure adequate lubrication of the claw clutch 32, which transmits a relatively high torque, at all operating speeds of the drive shaft 12; this flow emerges via lubricating oil openings in the claw faces of the claw clutch 32 and flows out into the transmission chamber 20. It is sufficient to provide lubricating oil openings in those faces of the claw clutch 3 that at the defined rotational direction of the drive shaft 12 must transmit the torque.

As FIGS. 2–5 show, to achieve this lubricating oil flow, an axial blind bore 54 is made in the drive shaft 12 from the face end having the driving claws 33, 34; near its bottom, this blind bore communicates with the lubricating oil groove 48 via a radial bore 55 in the drive shaft 12, and it is closed on the face end of the drive shaft 12 by a ball 56. One inclined bore 57 and 58 each is made from the two driving claws 33, 34 inward; the inclined bores discharge in the blind bore 54 and are closed on the face ends by a respective ball 59 and 60. From each inclined bore 57, 58, one first distributor bore 61 and 62, respectively (FIGS. 4 and 5), leads to the respective claw face 33*a* and 34*a* of the driving claws 33 and 34 that is located in a leading position in the rotational direction of the drive shaft 12 (arrow 63 in FIG. 5) and transmits the torque of the drive shaft 12 to the cross-type disk 40. In the sectional view of the driving claw 34 in FIG. 4, the distributor bore 62 can be seen in solid lines, while in the sectional view of the cross-type disk 40 of FIG. 5 it is suggested by dashed lines. The discharge openings of the first distributor bores 61, 62 form the aforementioned lubricating oil openings 64, 65 in the claw faces 33*a* and 34*a*. From the claw faces 41*b*, 43*b* of the clutch claws 41, 43 opposite these claw faces 33*a*, second distributor bores 66, 67 each lead to the other claw face 41*a*, 43*a* of the clutch claws 41, 43. Some of the lubricating oil emerging at the lubricating oil openings 64, 65 flows through these second distributor bores 66, 67 to the claw faces 41*a*, 43*a*, which in the rotational direction 63 of the drive shaft 12 transmit a torque to the driven claws 35, 36, where it flows through the mouths, forming further lubricating oil openings 68, 69, of the second distributor bores 66, 67 between the contacting faces of the clutch claws 41, 42 and driven claws 35, 36 of the eccentric disk 23. This construction assures that the claw faces 33*a*, 34*a*, 41*a*, 43*a* of the claw clutch 32 that transmit a torque will always be adequately supplied with lubricating oil.

Figure 6:
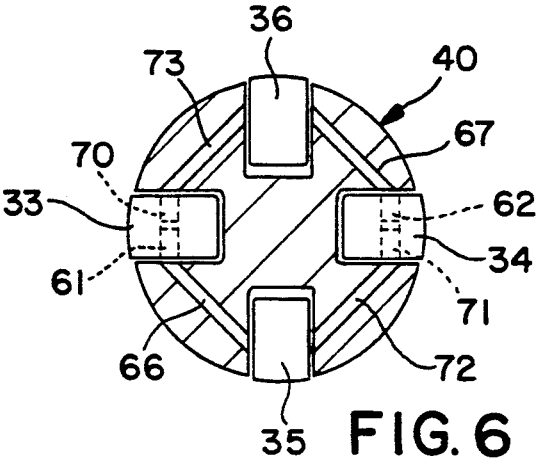

In the variant for lubrication of the claw clutch 32, shown in FIG. 6, all the claw faces are supplied with lubricating oil, regardless of whether or not they transmit a torque in whichever rotational direction of the drive shaft 12 is defined. As a result, it is possible to operate the fuel injection pump without change for both rotational directions of the drive shaft 12. To this end, further first distributor bores 70, 71 are additionally provided in each driving cam 33, 34; once again, they discharge into the inclined bores 48, 49 and into further lubricating oil openings in the other claw faces of the driving claws 33, 34. The cross-type disk 40 is provided with further second distributor bores 72, 73, which now pass through the clutch claws 42 and 44 in the same manner as the second distributor bores 66, 67 pass through the clutch claws 41, 43. The further first distributor 71 in the driving claw 34 is shown in dashed lines in the sectional view of FIG. 4.

By means of the lubricating oil loop, the hydraulic injection timing adjuster 30 for adjusting the onset of reciprocation of the pump piston 11 and thus the supply onset is simultaneously controlled relative to the rotational position of the drive shaft 12. To this end, the magnet valve 50 is triggered in a clocked manner, in such a way that the supply onset is shifted to "early" at full load and to "late" at partial load.

Since there is no motor oil pressure upon engine starting, the roller race 25 is installed with respect to the rotational position of the drive shaft 12 in a position in space such that when the control chamber 29 of the injection timing adjuster 30 is without pressure, the roller ring 25 assumes a position such that upon cold starting of the engine the supply onset of the pump piston 11 is at "early". Thus from the idling rpm onward, the injection adjusting piston 28 can be adjusted with the motor oil pressure. In warm engine starting, the required late position is attained in that the supply onset, defined by closure of the magnet valve 19, is shifted with respect to the rotational position of the pump piston 11.

The invention is not limited to the exemplary embodiment described above. For instance, the lubricating oil feed line 47 can connect the pump 46 to the lubricating oil groove 48 directly. In that case, the throttle valve 51 is then shifted forward toward the lubricating oil feed line 47 from the common connection point of the line segment 39 to the control chamber 29 of the injection timing adjuster 30 and of the magnet valve 50 to the lubricating oil feed line 47.

The lubricating oil container 45 may be omitted if the feed pump 46 is connected on the input side directly to the lubricating oil return line 49. In that case, the transmission chamber 20 takes over the function of the lubricating oil container 45. The transmission chamber 20 is then incorporated, by means of a separate inlet and a separate outlet, into the motor oil circulation loop of the engine. Suitably, the feed pump 46 is driven by the drive shaft 12. The rpm-dependent lubricating oil pressure in the transmission chamber 20 can additionally be controlled by means of a pressure control valve.

We claim:

1. A fuel injection pump for internal combustion engines, having a pump housing; a distributor piston guided rotatably and axially displaceably in the pump housing; a rotating drive shaft supported in the pump housing for at least the distributor piston; a transmission, which couples the drive shaft to the distributor piston and is disposed in a transmission chamber and which includes a claw clutch having torque transmitting faces to generate a rotational motion of the distributor piston, a roller race with rollers and an eccentric disk connected to the distributor piston to generate an axial displacement motion of the distributor piston, said disk is supported by its face end which carry cams on the rollers of the roller race by spring force; a lubricating oil circulation loop, which has a lubricating oil feed line, which discharges into a lubricating oil groove surrounding the drive shaft, and a lubricating oil return line leading away from the partly lubricating-oil-filled transmission chamber, a flow of lubricating oil exists through the drive shaft (12) from the lubricating oil groove (48) to the claw clutch (32), which flow emerges into the transmission chamber (20) via lubricating oil openings (64, 65, 68, 69) in at least those faces (33*a*, 34*a*, 41*a*, 43*a*) of the claw clutch (32) that transmit a torque.

2. A fuel injection pump as defined by claim 1, in which the claw clutch (32) has at least two driving claws (33, 34) connected to the drive shaft (12) in a manner fixed against relative rotation, at least two driven claws (35, 36) spatially offset from said at least two driving claws and connected to the eccentric disk (23) in a manner fixed against relative rotation, and one clutch disk (40) meshing with clutch claws (41–44) between the driving and driven claws (33, 34, 35, 36); said drive shaft (12) has an axial blind bore (54), which communicates via a radial bore (55) with the lubricating oil groove (48) and is closed on an end of the drive shaft (12) toward the clutch; that one inclined bore (57, 58) is made extending from the driving claws (33, 34) to the blind bore (54) and is closed on the face end; that first distributor bore (61, 62) lead from the inclined bore (57, 58) to the claw faces (33*a*, 34*a*), located in the lead in the rotational direction of the drive shaft (12), of the driving claws (33, 34) and there form the lubricating oil openings (64, 65) on an outlet side; and that second distributor bore (66, 67) lead from the claw faces (41*b*, 43*b*) of the clutch disk (40) that rest on the driving claw faces (33*a*, 34*a*) carrying the lubricating oil opening (64, 65), to the claw faces (41*a*, 43*a*) of the clutch disk (40) that rest in the rotational direction on the driven claw faces (35, 36) of the eccentric disk (23), where the distributor bores form the lubricating oil openings (68, 69) on the outlet side.

3. A fuel injection pump as defined by claim 2, in which first distributor bores (70, 71) additionally lead from the inclined bores (57, 58) to the other claw faces of the driving claws (33, 34) and there on the outlet side form further lubricating oil openings, and further second distributor bores (72, 73) lead from the claw faces of the clutch disk (40) that are oriented toward these claw faces carrying the further lubricating oil openings, to the other claw faces of the clutch disk (40), where they discharge on the outlet side in further lubricating oil openings.

4. A fuel injection pump as defined by claim 1, in which the drive shaft (12) is supported in two spaced-apart slide bearings (21, 22), and that the lubricating oil groove (48) is disposed between the two slide bearings (21, 22).

5. A fuel injection pump as defined by claim 2, in which the drive shaft (12) is supported in two spaced-apart slide bearings (21, 22), and that the lubricating oil groove (48) is disposed between the two slide bearings (21, 22).

6. A fuel injection pump as defined by claim 3, in which the drive shaft (12) is supported in two spaced-apart slide bearings (21, 22), and that the lubricating oil groove (48) is disposed between the two slide bearings (21, 22).

7. A fuel injection pump as defined by claim 1, in which a feed pump (46) that pumps lubricating oil from a lubricating oil container (45) is disposed in the lubricating oil loop.

8. A fuel injection pump as defined by claim 2, in which a feed pump (46) that pumps lubricating oil from a lubricating oil container (45) is disposed in the lubricating oil loop.

9. A fuel injection pump as defined by claim 3, in which a feed pump (46) that pumps lubricating oil from a lubricating oil container (45) is disposed in the lubricating oil loop.

10. A fuel injection pump as defined by claim 4, in which a feed pump (46) that pumps lubricating oil from a lubricating oil container (45) is disposed in the lubricating oil loop.

11. A fuel injection pump as defined by claim 1, in which a hydraulic injection timing adjuster (30) is provided, which has an injection adjusting piston (28), defining a control chamber (29), and a restoring spring (31), for adjusting the roller ring (25), in such a manner that the stroke onset of the distributor piston (11) is shifted to "early" with respect to the rotational position of the drive shaft (12); that the control chamber (29) is connected on one end, via a throttle (51), to the lubricating oil feed line (47) and at the other end, via a 2/2-way magnet valve (50), to the transmission chamber (20), the magnet valve being triggered in a clocked manner in order to establish an rpm-dependent lubricating oil pressure in the control chamber (29).

12. A fuel injection pump as defined by claim 2, in which a hydraulic injection timing adjuster (30) is provided, which has an injection adjusting piston (28), defining a control chamber (29), and a restoring spring (31), for adjusting the roller ring (25), in such a manner that the stroke onset of the distributor piston (11) is shifted to "early" with respect to the rotational position of the drive shaft (12); that the control chamber (29) is connected on one end, via a throttle (51), to the lubricating oil feed line (47) and at the other end, via a 2/2-way magnet valve (50), to the transmission chamber (20), the magnet valve being triggered in a clocked manner in order to establish an rpm-dependent lubricating oil pressure in the control chamber (29).

13. A fuel injection pump as defined by claim 3, in which a hydraulic injection timing adjuster (30) is provided, which has an injection adjusting piston (28), defining a control chamber (29), and a restoring spring (31), for adjusting the roller ring (25), in such a manner that the stroke onset of the distributor piston (11) is shifted to "early" with respect to the rotational position of the drive shaft (12); that the control chamber (29) is connected on one end, via a throttle (51), to the lubricating oil feed line (47) and at the other end, via a 2/2-way magnet valve (50), to the transmission chamber (20), the magnet valve being triggered in a clocked manner in order to establish an rpm-dependent lubricating oil pressure in the control chamber (29).

14. A fuel injection pump as defined by claim 4, in which a hydraulic injection timing adjuster (30) is provided, which has an injection adjusting piston (28), defining a control chamber (29), and a restoring spring (31), for adjusting the roller ring (25), in such a manner that the stroke onset of the distributor piston (11) is shifted to "early" with respect to the rotational position of the drive shaft (12); that the control chamber (29) is connected on one end, via a throttle (51), to the lubricating oil feed line (47) and at the other end, via a 2/2-way magnet valve (50), to the transmission chamber (20), the magnet valve being triggered in a clocked manner in order to establish an rpm-dependent lubricating oil pressure in the control chamber (29).

15. A fuel injection pump as defined by claim 7, in which a hydraulic injection timing adjuster (30) is provided, which has an injection adjusting piston (28), defining a control chamber (29), and a restoring spring (31), for adjusting the roller ring (25), in such a manner that the stroke onset of the distributor piston (11) is shifted to "early" with respect to the rotational position of the drive shaft (12); that the control chamber (29) is connected on one end, via a throttle (51), to the lubricating oil feed line (47) and at the other end, via a 2/2-way magnet valve (50), to the transmission chamber (20), the magnet valve being triggered in a clocked manner in order to establish an rpm-dependent lubricating oil pressure in the control chamber (29).

16. A fuel injection pump as defined by claim 11, in which the roller race (25) is installed in such a position in the pump housing (10) that when the control chamber (29) of the injection timing adjuster (30) is pressureless, the supply onset of the distributor piston (11) in cold engine starting is at "early" with respect to the rotational position if the drive shaft (12).

17. A fuel injection pump as defined by claim 12, in which the roller race (25) is installed in such a position in the pump housing (10) that when the control chamber (29) of the injection timing adjuster (30) is pressureless, the supply onset of the distributor piston (11) in cold engine starting is at "early" with respect to the rotational position if the drive shaft (12).

18. A fuel injection pump as defined by claim 13, in which the roller race (25) is installed in such a position in the pump housing (10) that when the control chamber (29) of the injection timing adjuster (30) is pressureless, the supply onset of the distributor piston (11) in cold engine starting is at "early" with respect to the rotational position if the drive shaft (12).

19. A fuel injection pump as defined by claim 14, in which the roller race (25) is installed in such a position in the pump housing (10) that when the control chamber (29) of the injection timing adjuster (30) is pressureless, the supply onset of the distributor piston (11) in cold engine starting is at "early" with respect to the rotational position if the drive shaft (12).

20. A fuel injection pump as defined by claim 15, in which the roller race (25) is installed in such a position in the pump housing (10) that when the control chamber (29) of the injection timing adjuster (30) is pressureless, the supply onset of the distributor piston (11) in cold engine starting is at "early" with respect to the rotational position if the drive shaft (12).

* * * * *